United States Patent [19]

Brenot

[11] Patent Number: 4,459,770

[45] Date of Patent: Jul. 17, 1984

[54] STEAM IRONING PRESS

[75] Inventor: Claude Brenot, Poitiers, France

[73] Assignee: Superba, Mulhouse, France

[21] Appl. No.: 397,360

[22] Filed: Jul. 12, 1982

[30] Foreign Application Priority Data

Jul. 15, 1981 [FR] France ..... 81 13735

[51] Int. Cl.[3] ..... D06F 71/16

[52] U.S. Cl. ..... 38/34

[58] Field of Search ..... 38/36, 27, 34

[56] References Cited

U.S. PATENT DOCUMENTS

| | | | |
|---|---|---|---|
| 1,981,410 | 11/1934 | Engbrecht et al. . | |
| 2,036,415 | 4/1936 | Kaimowitz . | |
| 2,149,605 | 3/1939 | Jones . | |
| 2,180,103 | 11/1939 | Engbrecht et al. . | |
| 2,398,909 | 4/1946 | Monsarrat . | |
| 2,422,917 | 6/1947 | Mallouf . | |
| 2,603,010 | 7/1952 | Foster | 38/36 |
| 2,629,947 | 3/1953 | Kolker . | |
| 3,968,581 | 7/1976 | Tsunoda . | |

FOREIGN PATENT DOCUMENTS

| | | |
|---|---|---|
| 593300 | 8/1925 | France . |
| 32591 | 2/1928 | France . |
| 501764 | 2/1971 | Switzerland . |
| 276193 | 8/1927 | United Kingdom . |
| 1587818 | 4/1981 | United Kingdom . |

*Primary Examiner*—Werner H. Schroeder
*Assistant Examiner*—Andrew M. Falik
*Attorney, Agent, or Firm*—Shenier & O'Connor

[57] ABSTRACT

Steam ironing press comprising a movable upper plate equipped with a heating sole and a fixed lower plate, covered with a porous resilient pad which ensures the even distribution of steam over the garment to be ironed. The steam is supplied by a steam generator situated in the base of the apparatus. The upper plate is firmly pressed against the garment, under the effect of a spring which is also used to compensate for the weight of the upper plate when the press is open. The effect of the spring is reversed by the addition of a mechanical support controlled by a press-controlling lever.

8 Claims, 5 Drawing Figures

STEAM IRONING PRESS

Figure 1A:
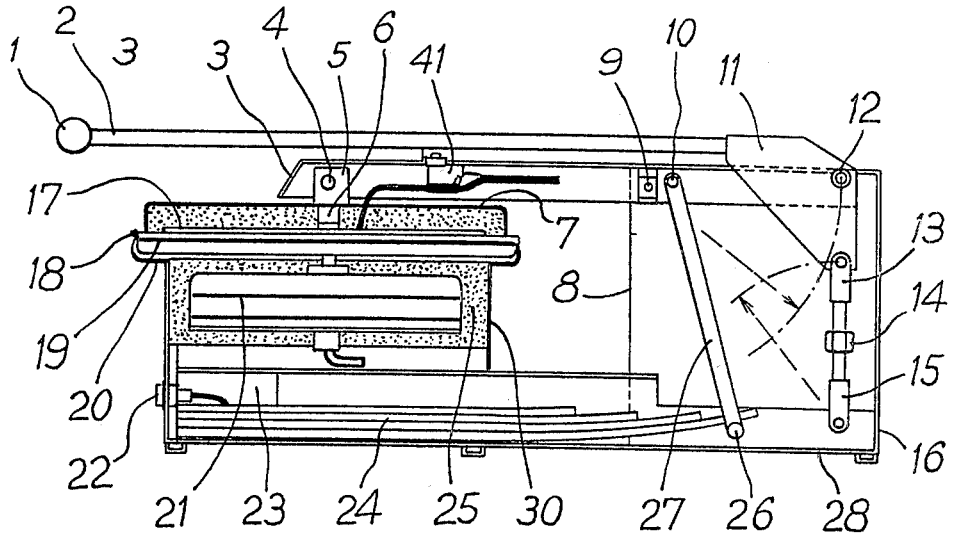

The present invention relates to a steam ironing press, of the type comprising a lower plate and an upper plate, movable one with respect to the other and capable of being applied with force by their opposed faces against a garment or piece of linen to be ironed, due to a simple spring mechanism; the lower plate being provided with a porous resilient pad, absorbing any differences in the thicknesses of the garments to be ironed and the distribution of the steam thereon, which steam is obtained from a generator of a known type situated in the base of machine; and the upper plate being equipped with means for heating the lower face or sole plate designed to come into contact with the garment to be ironed.

Among the known presses designed primarily for domestic use, systems are known which combine a rotating roll with a heating plate pressing the garment against said roll. One disadvantage with these systems is the shine which appears on the garments and another is the difficulty to iron pleats.

Other presses are known which are not equipped with a steam generator, and comprise a fixed plate and a generally movable heating plate; the garment to be ironed is generally pressed between the two plates by a device which mechanically or electrically amplifies the pressure or by a spring mechanism generally constituted by a combination of cams or levers permitting to move the amplifying point of a spring on either side of the pivoting axes of the plates. These devices are complex and expensive and it is necessary with such presses to wet the garment beforehand in order to obtain an acceptable ironing result.

It has also been proposed to produce ironing presses by incorporating a steam generator to the normally movable upper plate; the steam being distributed over the garment by a system of circular holes or slots made in the ironing plate. This particular arrangement complicates the manufacture of the press as it re-groups too many members on the movable part and, on the other hand, it has the disadvantage of causing usightly marks on the garment, due to marks made by the arrival of the steam on the ironing plate.

It is precisely the object of the present invention to overcome the aforesaid disadvantages by proposing an ironing press especially adapted for professional and domestic uses, which is easy to use, reliable and safe, compact and reasonably priced.

This object is reached with a steam ironing press comprising a movable upper plate provided with a heating sole plate, pivotally mounted about a pivot with respect to a fixed lower plate having means for dispensing steam produced by a steam generator, said upper plate being able to come into contact with the lower plate in the closed position of the press, whereby the garment inserted between the plates is tightly pressed in the closed position of the press, the pressure applying the plates one against the other being obtained under the effect of a spring of which one end is connected to an upper arm integral with the upper plate and the other end is secured to the frame integral with the lower plate of the press, said spring acting on the upper arm on the side opposite the upper plate with respect to said pivot and at such a distance of the pivot that the weight of the movable plate is balanced by the force of the spring, wherein said pivot is connected to said upper arm in such a manner that in the closed position of the press a clearance is defined in the vertical direction between said pivot and the support integral with said frame, with which said pivot cooperates, an additional mechanical support being provided to prevent the pivot from being in contact with said cooperating support in the closed position of the press, said additional mechanical support acting on the upper arm on the side opposite the movable plate with respect to said pivot, and at a greater distance than that from the application point of the spring on said upper arm.

Figure 2:
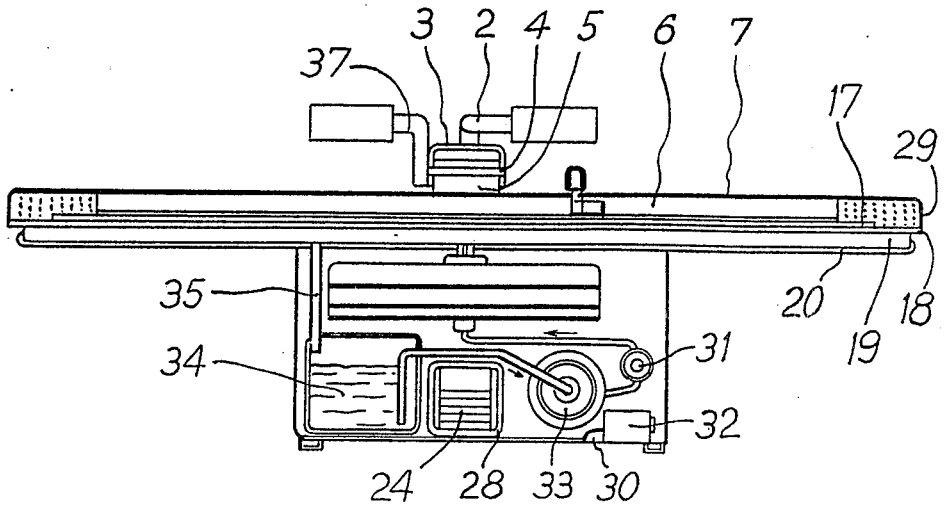
Figure 1B:
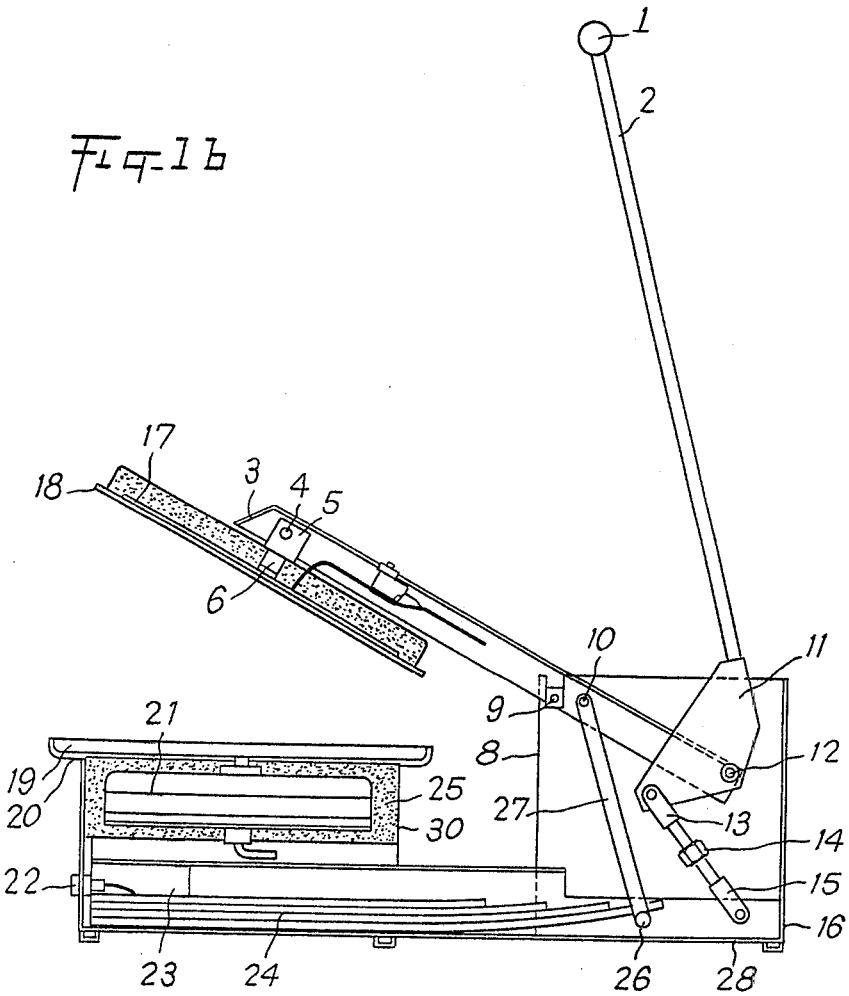
Figure 3:
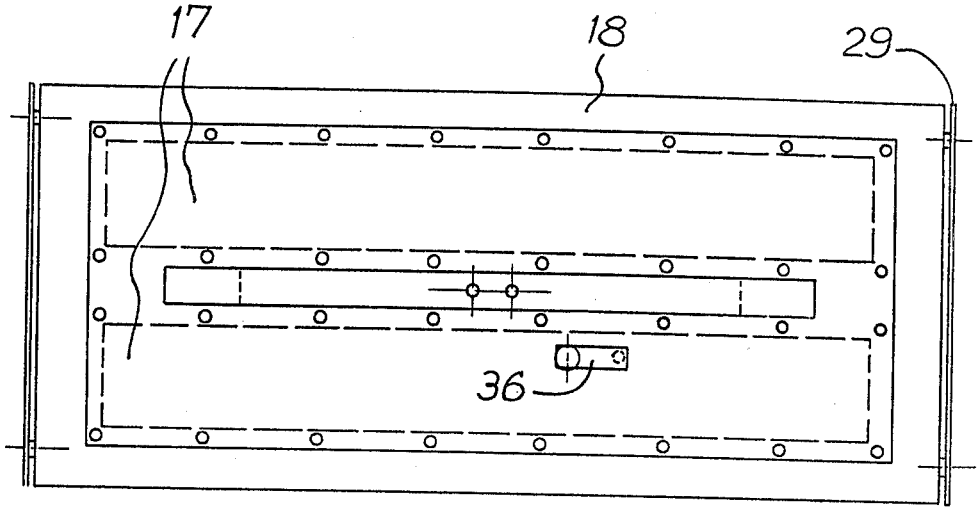
Figure 4:
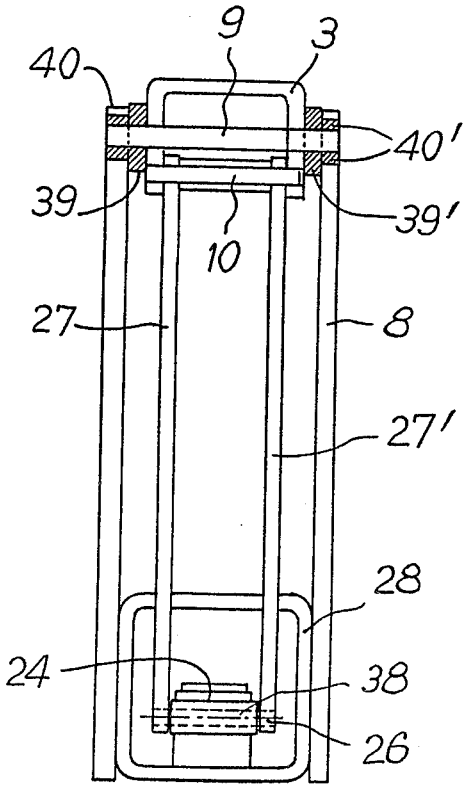

The invention will be more readily understood on reading the following description with reference to the accompanying drawings, in which:

FIG. 1*a* is a sectional profile view of one example of embodiment of the invention, seen in a closed, working position of the press, FIG. 1*b* is a sectional profile view of the press of FIG. 1*a*, but seen in an open position of the press, FIG. 2 is a front cross-sectional view, FIG. 3 is a cross-sectional view from above of the upper plate, FIG. 4 is a front cross-sectional view of the pivoting assembly.

FIG. 1 shows the press in the closed position, the upper plate 18 is positioned on the resilient pad 19 of the lower plate 20, the pivoting axle 9 is lifted in the fork under the effect of the back support constituted in the illustrated example by a knuckle joint comprising a control lever 2, hinged on the upper arm 3 by way of axle 12 and a lever of adjustable length comprising two forks 13, 15 and a screw 14 of reverse or differential threads. This supporting system enables one to lift the back of the upper arm 3 to release the axle 9 with a minimum of efforts. The back support is therefore essentially constituted by a knuckle joint (11 to 15), the axles of the levers of which extend one from the other when the press is closed so as to lift very slightly the pivoting axle 9 of the upper arm with only very little manoeuvering force, while affording a strong ironing pressure.

The spring 24, which in the illustrated example is a leaf spring subjected to bending stress, or any other spring of a known type exerts a tension on the arm 3 via small connecting rods 27 and axles 10 and 26.

The spring is also secured to the lower arm 28 by way of a wedge 23 together with the lower axle of the fork 15.

The steam generator 21 is, in the illustrated example, secured to the lower plate 20, inside the base 30. It can be insulated with an insulating material such as rockwool 25.

FIG. 2 shows the steam generator being supplied with water, from a water tank 34, via a pump 33 and an adjustable valve 31 permitting regulator of the quantity of steam produced. Said figure also shows a tube 35 via which the condensation water is returned to the tank.

FIGS. 1 and 2 also illustrate an embodiment of the upper plate, which is detailed in FIG. 3. The sole plate 18 is heated by an electric element 17, which latter is regulated by way of an adjustable thermostat 36. The whole assembly is protected by a cap 29.

The control lever 2 comprises a control knob 1. It is completed by an opening lever 37 directly linked to be upper arm 3. With that lever 37, the operator, after unlocking the back support via the lever 2, can open the press, with only a slight movement of the hand. The upper plate is hinged on the upper arm 3 by way of an axle 4, of a fork 5 and of a means 6 distributing the effort over the sole plate 18.

FIG. 4 shows a detail of the pivoting assembly of upper arm 3 which pivotes inside bearings 39 and 39' which themselves slide in the shanks 40 and 40' of the fork 8 connected to the lower arm 28.

The spring 24 rests on the roller 38, which roller is mounted for pivoting about axle 26 on the connecting rods 27 and 27'. The connection rods 27 and 27' transfer the traction of the spring to upper arm 3 via the axle 10.

The steam production is, in the aforesaid example, controlled by the lever 2 which, at end-of-course, actuates the contact 41, under the effect of an added pressure from the hand. It is thus possible to iron dry by not exerting this end-of-course pressure.

Thus, according to the invention, a powerful tension spring 24 acts on the arm 3 supporting the upper plate 18 at the back of the plates pivoting axle 9 and at a distance from said axle 9 such that the weight of the movable plate 18 is balanced by the force of the spring 24 in order to facilitate the use of the press. The pivoting axle 9 rests at its ends in a fork 8 of the base. The axle 9 being integral with the upper plate 18, if the latter is lifted, the axle 9 is also lifted in the fork 8, thus releasing its ends from their support (40,40') in the fork 8 and in the base. This lifting movement is, according to the invention, deliberately caused by adding a back support controlled by the lever 2 which presses the press closed.

This support (11 to 15) acts on the upper arm 3 reversedly to the movable plate 18 with respect to the pivoting axle 9 and at a greater distance than that of the point where the spring 24 acts on the arm 3. It eliminates the support for the upper arm 3 on the pivoting axle 9, the force of the spring being as a result distributed directly, on the one hand, over the upper plate 18, thus causing the required ironing pressure, and on the other hand on the back support (11 to 15).

To open the press, it suffices to remove the back support (11 to 15) by actuating the operating lever 2, thus restoring the effect of the pivoting axle 9 and the action of the spring 24 with respect to said axle 9.

Due to this particular arrangement, the said spring 24 which remains fastened to the same point on the upper arm and on the base of the press, can produce, alternately, the ironing pressure and the effect balancing the weight of the upper plate.

The efficiency of the press according to the invention is further improved by the addition of a steam generator preferably of the type with direct evaporation and with no accumulation of pressurized steam, contrary to the systems using a conventional boiler, so as to offer greater safety by eliminating the risks of explosion.

The steam is distributed over the garment to be ironed through the porous resilient pad which covers the lower plate. Besides, absorbing the differences of thickness of the garment to be ironed, this pad also ensures the filtering of the steam, thereby stopping any lime deposits resulting from evaporation, which would otherwise stain the garment.

If the heat communicated to the lower plate by the steam generator is insufficient, there is no steam condensation on the latter and therefore no water present on the garment. If the steam generator used does not give out enough heat, it may be useful to provide means for recovering the condensed water which can be collected in the reservoir of the apparatus. Another advantage of the arrangement according to the invention is to enable the steam ironing of delicate sunthetic fabrics, since the temperature of the upper plate can be regulated without affecting the production of steam.

I claim:

1. A steam ironing press comprising a frame, a lower plate having steam dispensing means secured to said frame, a support on said frame, a movable upper plate having a heating sole plate, an upper arm integral with said upper plate, means including a pivot for mounting said upper arm on said support for movement between an open position of the press and a closed position of the press at which said upper plate is able to contact said lower plate whereby a garment inserted between the plates is tightly pressed in the closed position of the press, a spring, means securing one end of said spring to said frame, means connecting the other end of said spring to said upper arm to press said plates together, said spring acting on the upper arm on a side opposite to the upper plate with reference to the pivot and at such a distance from the pivot that the weight of the movable plate is balanced by the force of the spring, said pivot being so connected to said upper arm that in the closed position of the press a vertical clearance exists between said pivot and said support, and an additional mechanical support acting on said upper arm on the side opposite the movable plate with reference to the pivot and at a distance therefrom greater than that between the pivot and the point of action of the spring on the upper arm to prevent the pivot from seating on said support in the closed position of the press.

2. A press as claimed in claim 1, wherein it further comprises an actuating lever, one end of which is hingedly secured to said additional support so as to pivot about the rear end of the upper arm, whereby said pivot connected to the upper arm is lifted with respect to its cooperating support when the actuating lever is in a lowered position to cause the additional support to lift up the rear end of the upper arm.

3. A press as claimed in claim 1, wherein said additional support is constituted by a knuckle joint which comprises a first level integral with said actuating lever, said first lever being hinged on a first axle at the rear end of the upper arm, and a second lever hinged on a second axle on the first lever so as to be aligned with said first axle whenever the actuating lever is in its lowered position.

4. A press as claimed in claim 2, wherein the actuating lever presents a first travel from its raised position to a first lowered position to cause the additional support to lift up the rear end of the upper arm and a second travel from said first lowered position to a second lowered position to control the production of steam by said steam generator.

5. A press as claimed in claim 3, wherein said second lever is adjustable in length and comprises two forks and a screw of reverse or differential threads.

6. A press as claimed in claim 1, wherein said spring is a leaf spring subjected to bending stress, and is connected to the upper arm via small connecting rods mounted for pivoting about axles.

7. A press as claimed in claim 1, wherein the lower plate is integral with a direct evaporation steam generator.

8. A steam ironing press comprising a frame, a lower plate having steam dispensing means secured to said frame, a support on said frame, a movable upper plate having a heating sole plate, an upper arm integral with said upper plate, means including a pivot for mounting said upper arm on said support for movement between an open position of the press and a closed position of the press at which said upper plate is able to contact said lower plate whereby a garment inserted between the plates is tightly pressed in the closed position of the press, a spring, means securing one end of said spring to said frame, means connecting the other end of said spring to said upper arm to press said plates together, said spring acting on the upper arm on a side opposite to the upper plate with reference to the pivot and at such a distance from the pivot that the weight of the movable plate is balanced by the force of the spring, said pivot being so connected to said upper arm that in the closed position of the press a vertical clearance exists between said pivot and said support, an additional mechanical support acting on said upper arm on the side opposite the movable plate with reference to the pivot and at a distance therefrom greater than that between the pivot and the point of action of the spring on the upper arm to prevent the pivot from seating on said support in the closed position of the press, and a control lever, said additional support being constituted by a knuckle joint comprising a first lever integral with said control lever, a first axle pivotally mounting said first lever at the rear end of the upper arm, a second lever, a second axle on the first lever for pivoting said second lever on the first lever so as to be aligned with the first axle when the control lever is down, said second lever being adjustable and comprising two forks and reverse threads.

* * * * *

UNITED STATES PATENT AND TRADEMARK OFFICE

CERTIFICATE OF CORRECTION

PATENT NO. : 4,459,770

DATED : July 17, 1984

INVENTOR(S) : Claude Brenot

It is certified that error appears in the above-identified patent and that said Letters Patent are hereby corrected as shown below:

Column 4, line 38, " 1 " should read -- 2 --.

Column 4, line 40, "level" should read -- lever --.

Signed and Sealed this

*Twenty-eighth* Day of *May 1985*

[SEAL]

*Attest:*

DONALD J. QUIGG

*Attesting Officer* *Acting Commissioner of Patents and Trademarks*